US011059310B2

(12) United States Patent
Inose

(10) Patent No.: US 11,059,310 B2
(45) Date of Patent: Jul. 13, 2021

(54) PRINTING APPARATUS

(71) Applicant: KOMORI CORPORATION, Tokyo (JP)

(72) Inventor: Satoshi Inose, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 272 days.

(21) Appl. No.: 16/305,035

(22) PCT Filed: May 31, 2017

(86) PCT No.: PCT/JP2017/020205
§ 371 (c)(1),
(2) Date: Nov. 27, 2018

(87) PCT Pub. No.: WO2017/209171
PCT Pub. Date: Dec. 7, 2017

(65) Prior Publication Data

US 2020/0316974 A1 Oct. 8, 2020

(30) Foreign Application Priority Data

Jun. 1, 2016 (JP) ..... JP2016-109762

(51) Int. Cl.
*B41J 13/00* (2006.01)
*B65H 3/08* (2006.01)
(Continued)

(52) U.S. Cl.
CPC ..... *B41J 29/393* (2013.01); *B41J 3/60* (2013.01); *B41J 13/0009* (2013.01); *B65H 3/08* (2013.01)

(58) Field of Classification Search
CPC ..... B41J 29/393; B41J 3/60; B41J 13/0009; B41J 13/223; B41J 13/0018;
(Continued)

(56) References Cited

U.S. PATENT DOCUMENTS 8,070,286 B2 * 12/2011 Nakagawa ..... B41J 13/103 347/104
8,585,048 B2 11/2013 Yamagishi et al.
(Continued)

FOREIGN PATENT DOCUMENTS

CN 1636758 A 7/2005
CN 103373084 A 10/2013
(Continued)

OTHER PUBLICATIONS

Machine translation of JP 2002-179265, published on Jun. 2002 (Year: 2002).*
(Continued)

*Primary Examiner* — Huan H Tran
(74) *Attorney, Agent, or Firm* — Womble Bond Dickinson (US) LLP

(57) ABSTRACT

A printing apparatus includes a printing cylinder (14) that can hold sheets (4) and transfer them one by one continuously, first to fourth inkjet heads (41-44), and a feeder unit (2). The printing apparatus includes a speed reducer (72) that switches the speed of the feeder unit (2) between single-sided printing and double-sided printing. In single-sided printing, the feeder unit (2) is driven at a first supply speed at which the sheets (4) are supplied to the printing cylinder (14) one by one continuously, and the printing cylinder (14) is driven at a transfer speed at which the sheets (4) supplied from the feeder unit (2) one by one continuously are transferred. In double-sided printing, the printing cylinder (14) is driven at the transfer speed, and the feeder unit (2) is driven at a second supply speed that is ½ the first supply speed. The printing apparatus that operates stably in both single-sided printing and double-sided printing can be provided.

4 Claims, 12 Drawing Sheets

(51) Int. Cl.
*B41J 29/393* (2006.01)
*B41J 3/60* (2006.01)

(58) Field of Classification Search
CPC ..... B65H 2403/80; B65H 2513/108; B65H 2511/414; B65H 7/14; B65H 3/0825; B65H 2406/412; B65H 2406/3612; B65H 9/105; B65H 5/24
See application file for complete search history.

(56) References Cited

U.S. PATENT DOCUMENTS

| | | | | |
|---|---|---|---|---|
| 9,427,985 | B2 * | 8/2016 | Taniguchi | B41J 13/0009 |
| 9,457,598 | B2 * | 10/2016 | Suda | B41J 3/60 |
| 10,447,875 | B2 * | 10/2019 | Suzuki | B65H 5/24 |
| 2012/0161388 | A1 | 6/2012 | Yamagishi et al. | |
| 2015/0256694 | A1 * | 9/2015 | Suzuki | B41J 13/0018 358/1.12 |

FOREIGN PATENT DOCUMENTS

| | | | |
|---|---|---|---|
| CN | 105291608 | A | 2/2016 |
| JP | 59-014452 | Y2 | 4/1984 |
| JP | 06-063537 | U | 9/1994 |
| JP | 2002-173234 | A | 6/2002 |
| JP | 2002-179265 | A | 6/2002 |
| JP | 2007-065535 | A | 3/2007 |
| JP | 2008-056406 | A | 3/2008 |
| JP | 2012-131127 | A | 7/2012 |
| JP | 2013-241264 | A | 12/2013 |
| JP | 2013-241269 | A | 12/2013 |
| JP | 2014-198629 | A | 10/2014 |
| JP | 2017-043420 | A | 3/2017 |

OTHER PUBLICATIONS

Machine translation of JP 2002-173234, published on Jun. 2002 (Year: 2002).*
Machine translation of JP 2013-241269, published on Dec. 2013.*
Office Action received for Japanese Patent Application No. 2018-520951, dated Aug. 13, 2019, 10 pages (5 pages of English Translation and 5 pages of Office Action).
Office Action received for Chinese Patent Application No. 201780033539.9, dated Oct. 8, 2019, 12 pages (6 pages of English Translation and 6 pages of Office Action).
Office Action received for Japanese Patent Application No. 2018-520951, dated Nov. 14, 2019, 5 pages (3 pages of English Translation and 2 pages of Office Action).
Supplementary European Search Report and Search Opinion received for EP Patent Application No. 17806722.9, dated Dec. 12, 2019, 9 pages.
International Search Report and Written Opinion received for PCT Patent Application No. PCT/JP2017/020205, dated Aug. 15, 2017, 19 pages (10 pages of English Translation and 9 pages of Original Document).
International Preliminary Report on Patentability received for PCT Patent Application No. PCT/JP2017/020205, dated Dec. 13, 2018, 17 pages (10 pages of English Translation and 7 pages of Original Document).
Office Action received for Japanese Patent Application No. 2018-520951, dated Mar. 24, 2020, 8 pages (4 pages of English Translation and 4 pages of Office Action).

* cited by examiner

PRINTING APPARATUS

TECHNICAL FIELD

The present invention relates to a printing apparatus that performs digital printing on one or both surfaces of a sheet.

BACKGROUND ART

A conventional digital printing apparatus that performs printing by applying ink to a sheet from an inkjet head is described in, for example, patent literature 1. The digital printing apparatus disclosed in patent literature 1 adopts an arrangement capable of performing single-sided printing to perform printing on one surface of a sheet and double-sided printing to perform printing on both surfaces of a sheet.

When this digital printing apparatus performs single-sided printing, new sheets are continuously supplied to a printing cylinder. When this digital printing apparatus performs double-sided printing, unprinted new sheets and single-sided printed sheets having undergone printing on one surface are alternately aligned and held on the printing cylinder. A new sheet is supplied from a sheet supply device to the printing cylinder via a swing arm shaft pregripper and a supply-side transfer cylinder.

The swing arm shaft pregripper and the supply-side transfer cylinder operate in synchronism with rotation of the printing cylinder. The printing cylinder includes first to third gripper devices that grip and hold a sheet. Each of the swing arm shaft pregripper and the supply-side transfer cylinder includes a pair of gripper devices. The gripper devices of the supply-side transfer cylinder change to a state in which they can grip a sheet with one of the first to third gripper devices of the printing cylinder every time the supply-side transfer cylinder rotates once. The gripper devices of the swing arm shaft pregripper hand over a sheet from the sheet supply device to the supply-side transfer cylinder every time the supply-side transfer cylinder rotates once.

The sheet supply device includes a suction device that sucks and picks up sheets one by one from a sheet stacking unit, and a feeder board that feeds sheets stacked by the suction device to the swing arm shaft pregripper side one by one.

The suction device includes a suction portion that comes into contact with a sheet. The suction portion is connected to a negative pressure source and a positive pressure source via a rotary air valve that switches between ON and OFF along with rotation of the machine. The suction portion receives a negative pressure when picking up a sheet from the sheet stacking unit, and receives a positive pressure when stacking a sheet on the feeder board.

The feeder board generally adopts an arrangement that places a sheet on a belt and transfers it. The belt often employs an arrangement in which it moves while sucking a sheet. A sheet is placed on the belt, sucked by it, and moved and transferred together with the belt. Front lays against which the leading edge of a sheet abuts are provided on the downstream side of the belt in the transfer direction. The sheet transferred by the belt abuts against the front lays, its movement is restricted, and the sheet stops.

The leading edge of a sheet placed on the feeder board by the suction device is inserted below a preceding sheet on the feeder board. The two sheets aligned in the transfer direction on the feeder board are transferred in a state in which they partially overlap each other in the transfer direction.

The sheet supply device supplies sheets continuously in single-sided printing and supplies sheets intermittently, that is, every other sheet in double-sided printing. The operating speeds of the suction device and the feeder board do not differ between single-sided printing and double-sided printing. The operating speeds are constant in accordance with the drive speed of the printing apparatus. Thus, the overlapping width (the length of a portion that contacts the belt in the transfer direction) of a sheet transferred on the feeder board with respect to the belt differs between single-sided printing and double-sided printing. The overlapping width in double-sided printing is double the overlapping width in single-sided printing.

RELATED ART LITERATURE

Patent Literature

Patent Literature 1: Japanese Patent Laid-Open No. 2013-241269

DISCLOSURE OF INVENTION

Problem to be Solved by the Invention

The printing apparatus disclosed in patent literature 1 may cause a transfer error in the sheet supply device at the time of double-sided printing. This transfer error arises because the overlapping width of a sheet transferred on the feeder board with respect to the belt becomes larger than that in single-sided printing. A large overlapping width relatively widens a range of the sheet sucked by the belt. When this sheet abuts against the front lays, it is pressed in the transfer direction by a relatively large force and bends. In such a case, the gripper devices of the swing arm shaft pregripper cannot normally grip the leading edge of the sheet, generating the above-described transfer error.

The present invention has as its object to provide a printing apparatus that operates stably in both single-sided printing and double-sided printing.

Means of Solution to the Problem

In order to achieve the above object of the present invention, there is provided a printing apparatus which performs digital printing on one or both surfaces of a sheet, comprising a sheet transfer unit configured to hold sheets and transfer the sheets one by one continuously, a printing unit configured to perform printing on the sheet transferred by the sheet transfer unit, a sheet supply unit configured to supply the sheets one by one to the sheet transfer unit, and speed switching means, for the sheet supply unit, for switching a speed of the sheet supply unit between a case in which printing is performed on one surface of the sheet and a case in which printing is performed on both surfaces of the sheet, wherein when printing is performed on one surface of the sheet, the sheet supply unit is driven at a first supply speed at which the sheets are supplied to the sheet transfer unit one by one continuously, and the sheet transfer unit is driven at a transfer speed at which the sheets supplied from the sheet supply unit one by one continuously are transferred, and when printing is performed on both surfaces of the sheet, the sheet transfer unit is driven at the transfer speed and the sheet supply unit is driven at a second supply speed which is ½ the first supply speed.

Effect of the Invention

According to the present invention, when performing printing on both surfaces of a sheet, the supply speed of the sheet supply unit becomes ½ the supply speed in single-sided printing. In this case, the supply interval when supplying a sheet to the sheet transfer unit becomes double the supply interval in single-sided printing. In double-sided printing, the sheet is supplied in the same supply form as that in single-sided printing.

According to the present invention, the printing apparatus that operates stably in both single-sided printing and double-sided printing can be provided.

BEST MODE FOR CARRYING OUT THE INVENTION

First Embodiment

An embodiment of a printing apparatus according to the present invention will be described below in detail with reference to FIGS. 1 to 16.

Figure 1:
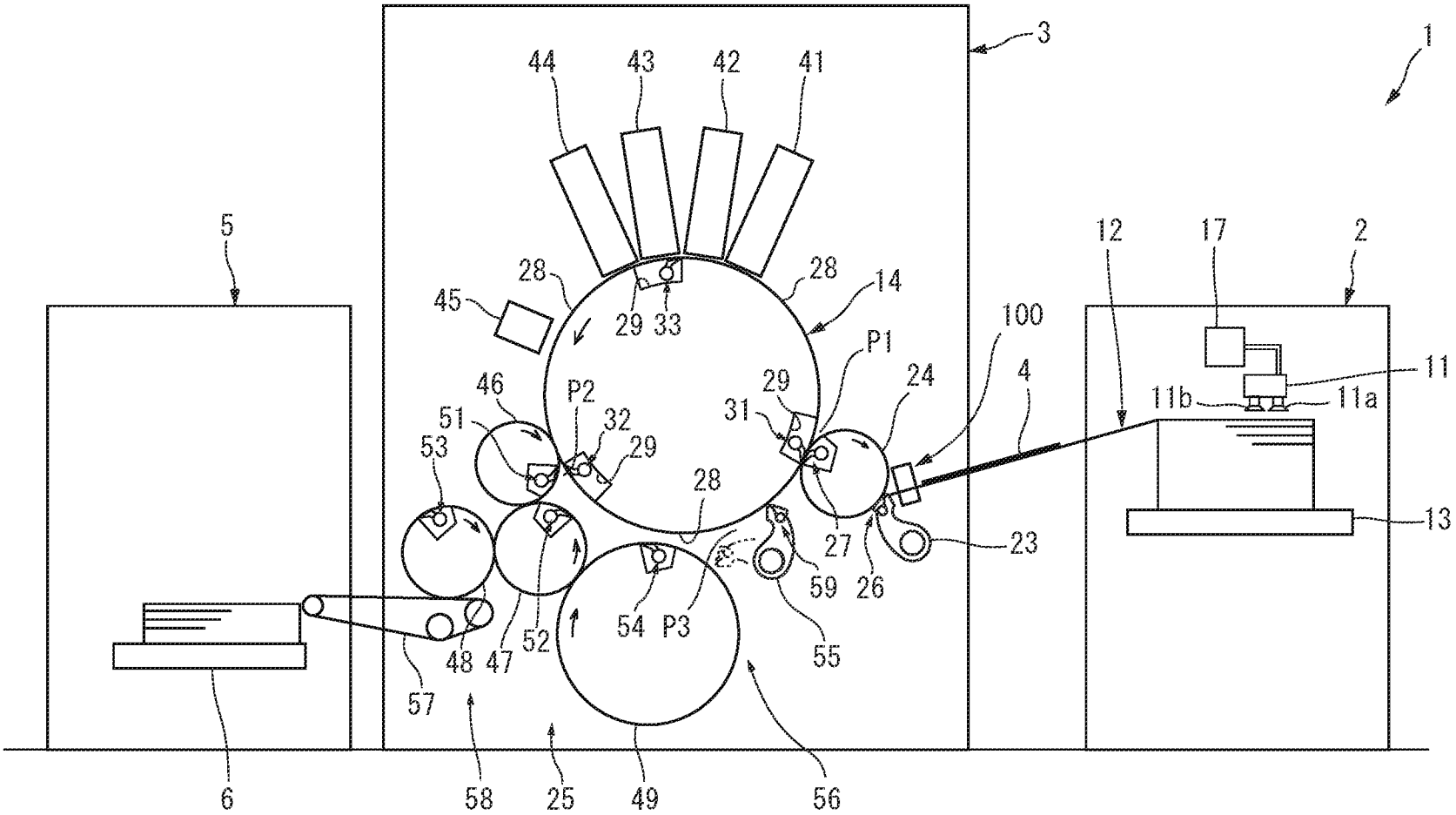
FIG. 1 is a side view showing the arrangement of a printing apparatus according to the present invention.

A printing apparatus 1 shown in FIG. 1 is an apparatus that transfers a sheet 4 to a printing unit 3 from a feeder unit 2 located at a rightmost position in FIG. 1 and performs digital printing on one or both surfaces of the sheet 4 in the printing unit 3. The sheet 4 having undergone printing in the printing unit 3 is fed to a delivery unit 5 and discharged to a delivery pile 6.

<Explanation of Feeder Unit>

The feeder unit 2 is a stream feeder that transfers a plurality of sheets 4 in a state in which they partially overlap each other in the transfer direction. The feeder unit 2 includes a suction device 11 and a feeder board 12. In this embodiment, the feeder unit 2 corresponds to "sheet supply unit" in the present invention.

The sheet 4 supplied from the feeder unit 2 is stacked on a feeder pile 13 and held. The suction device 11 reciprocates between a pickup position above the feeder pile 13 and a release position on the feeder board 12 side. Power to drive the feeder unit 2 including the suction device 11 is transmitted via a drive connecting means 16 (see FIG. 2) from a drive device 15 (see FIG. 2) that drives a printing cylinder 14 of the printing unit 3 to be described later. The arrangement of the drive connecting means 16 will be described later.

The suction device 11 includes suction portions 11*a* and 11*b* that suck and hold the sheets 4 one by one. The suction portions 11*a* and 11*b* are connected to a negative pressure source and a positive pressure source (neither is shown) via an air passage switching valve 17. The air passage switching valve 17 connects the negative pressure source to the suction portions 11*a* and 11*b* in the process of moving the suction device 11 from the pickup position on the feeder pile 13 side to the release position on the feeder board 12 side. The air passage switching valve 17 connects the positive pressure source to the suction portions 11*a* and 11*b* when the suction device 11 places the sheet 4 on the feeder board 12 at the release position.

The feeder board 12 extends in a downslope state between the feeder pile 13 and the printing unit 3. The feeder board 12 includes a belt 21 (see FIG. 5) that moves while a plurality of sheets 4 are placed on it. Although not shown, many through holes are formed in the belt 21. The feeder board 12 also includes an air suction device (not shown) that sucks air via the through holes of the belt 21. Air is sucked via the through holes of the belt 21, and the sheet 4 placed on the belt 21 is sucked to the belt 21. While the sheet 4 is sucked to the belt 21, the belt 21 moves and transfers the sheet 4.

Figure 5:
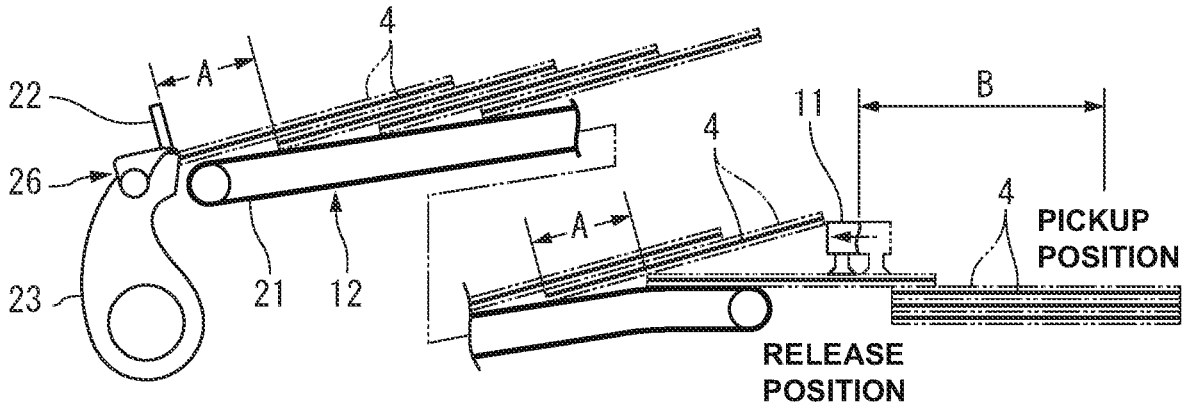
FIG. 5 is a schematic view for explaining the operation of the sheet supply unit.

Front lays 22 against which the leading edge of the sheet 4 abuts are provided near the downstream end of the feeder board 12 in the transfer direction, as shown in FIG. 5. The front lays 22 are components that constitute part of a register unit 100 (see FIG. 1) to be described later. The sheet 4 transferred by the feeder board 12 abuts against the front lays 22 and stops.

<Explanation of Printing Unit>

As shown in FIG. 1, the printing unit 3 includes the printing cylinder 14, the register unit 100, a swing arm shaft pregripper 23 on the sheet supply side, a supply-side transfer cylinder 24, and a transfer mechanism 25.

The printing cylinder 14 receives the sheet 4 from the supply-side transfer cylinder 24, holds the sheet 4 on the peripheral surface, and transfers it. In this embodiment, the printing cylinder 14 corresponds to "sheet transfer unit" in the present invention.

The register unit 100 adjusts positions of the sheet 4 transferred by the feeder board 12 in the transfer direction and the lateral direction, details of which will be described later.

The swing arm shaft pregripper 23 swings between the feeder board 12 and the supply-side transfer cylinder 24, and hands over the sheet 4 from the feeder board 12 to the supply-side transfer cylinder 24.

The supply-side transfer cylinder 24 rotates while holding the sheet 4, and hands over the sheet 4 to the printing cylinder 14.

The transfer mechanism 25 has a function of feeding the printed sheet 4 to the delivery unit 5, and a function of reversing the sheet 4 having undergone printing on one surface in double-sided printing and feeding it to the printing cylinder 14.

Cylinders constituting the swing arm shaft pregripper 23, the supply-side transfer cylinder 24, the printing cylinder 14, and the transfer mechanism 25 respectively include gripper devices to hand over the sheet 4. The gripper device of the swing arm shaft pregripper 23 will be referred to as a first gripper device 26, and the gripper device of the supply-side transfer cylinder 24 will be referred to as a second gripper device 27. The gripper device of the transfer mechanism 25 will be described later.

The printing cylinder 14 is a so-called triple-diameter cylinder and has transfer surfaces 28 at three portions in the rotating direction. The transfer surfaces 28 are formed from the outer peripheral surface of the printing cylinder 14 and provided at positions at which the printing cylinder 14 is trisected in the rotating direction when viewed from the axial direction. Outer periphery notches 29 are provided between the adjacent transfer surfaces 28. Third to fifth gripper devices 31 to 33 are provided at the outer periphery notches 29 at three portions on the printing cylinder 14.

Figure 2:
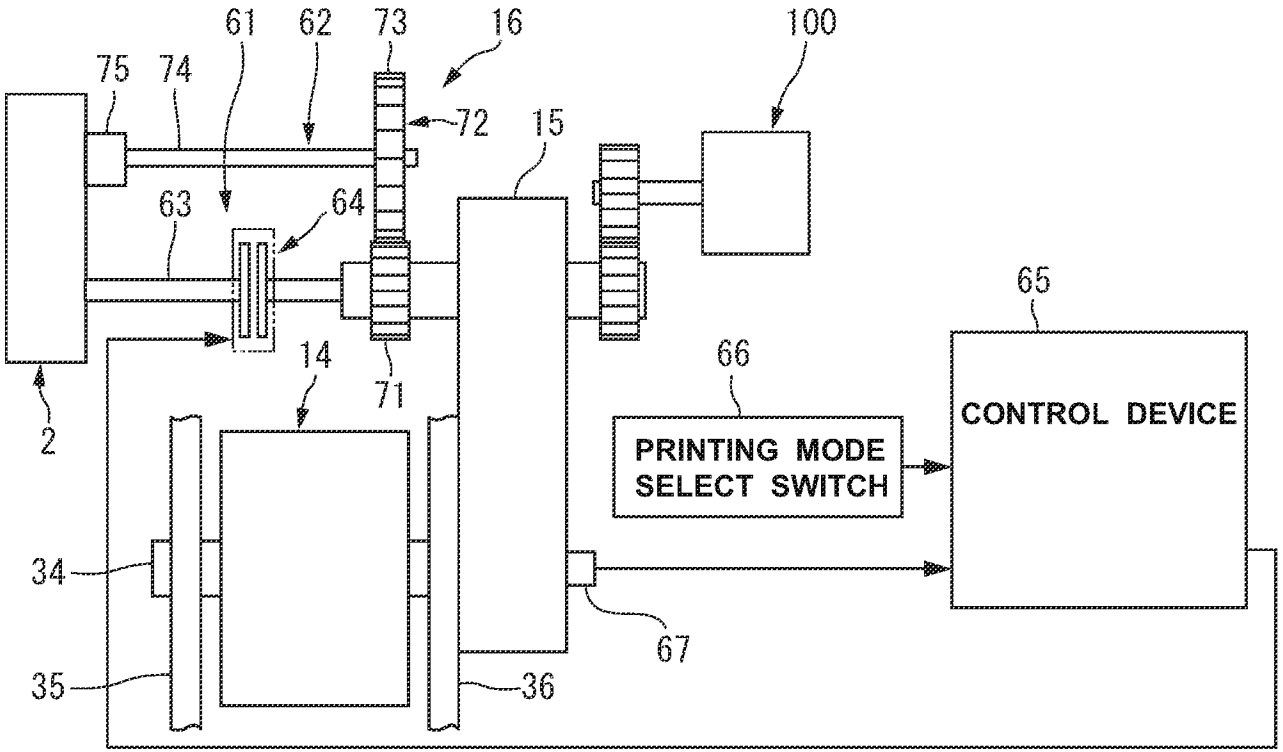
FIG. 2 is a schematic view showing the arrangement of the drive system of a sheet supply unit according to the first embodiment.

The swing arm shaft pregripper 23, the supply-side transfer cylinder 24, the printing cylinder 14, and the register unit 100 are connected to the common drive device 15 (see FIG. 2). The swing arm shaft pregripper 23, the supply-side transfer cylinder 24, and the printing cylinder 14 are driven by the drive device 15 and operate in synchronism with each other, as shown in FIGS. 3 and 4.

The swing arm shaft pregripper 23 swings and reciprocates between a receiving position (see FIG. 3) where the first gripper device 26 comes close to the feeder board 12 and a handover position (see FIG. 4) where the first gripper device 26 comes close to the supply-side transfer cylinder 24. The swing arm shaft pregripper 23 reciprocates once to rotate the supply-side transfer cylinder 24 once. The supply-side transfer cylinder 24 rotates once to rotate the printing cylinder 14 by ⅓.

Figure 3:
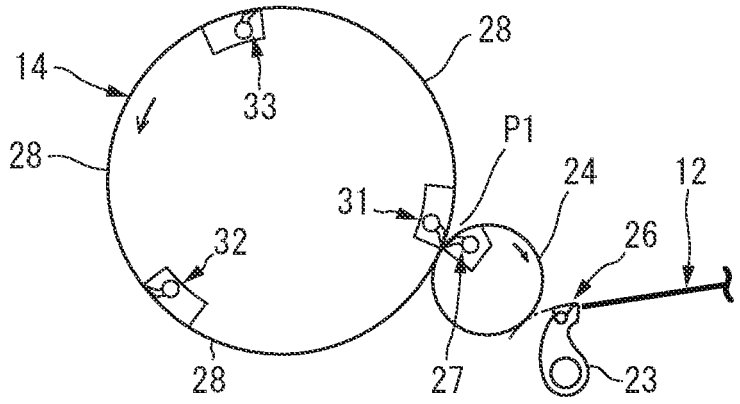
FIG. 3 is a side view of a printing cylinder, a supply-side transfer cylinder, and a swing arm shaft pregripper.
Figure 4:
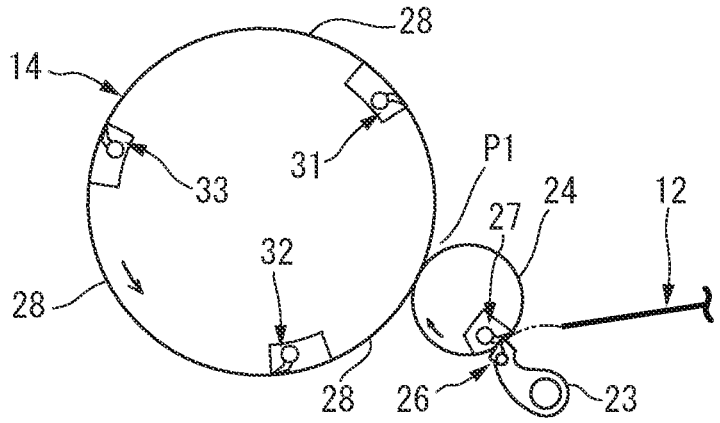
FIG. 4 is a side view of the printing cylinder, the supply-side transfer cylinder, and the swing arm shaft pregripper.

FIG. 3 shows a state in which the first gripper device 26 of the swing arm shaft pregripper 23 grips the sheet 4 on the feeder board 12 when the third gripper device 31 of the printing cylinder 14 and the second gripper device 27 of the supply-side transfer cylinder 24 come close to each other at a supply position P1 and can grip the sheet 4. FIG. 4 shows a state in which the printing cylinder 14 rotates by ⅙ from the position shown in FIG. 3 when the first gripper device 26 of the swing arm shaft pregripper 23 and the second gripper device 27 of the supply-side transfer cylinder 24 can grip the sheet 4. Note that the timing when the first gripper device 26 receives the sheet 4 from the feeder board 12 and the timing when the second and third gripper devices 27 and 31 can grip the sheet 4 need not coincide with each other, unlike FIG. 3.

The printing cylinder 14 holds the sheet 4 by the third to fifth gripper devices 31 to 33, sucks it to the transfer surface 28, and transfers it. As shown in FIG. 2, a spindle 34 extends from two ends of the printing cylinder 14 in the axial direction (lateral direction in FIG. 2), and a pair of frames 35 and 36 is rotatably supported via the spindle 34.

The drive device 15 is connected to the spindle 34. The drive device 15 uses a motor (not shown) as a power source and drives all actuators that operate at the time of printing in the printing apparatus 1 including the printing cylinder 14.

As shown in FIG. 1, first to fourth inkjet heads 41 to 44 and an ink drying lamp 45 are arranged in this order near the periphery of the printing cylinder 14 on the downstream side of the supply-side transfer cylinder 24 in the sheet transfer direction.

The first to fourth inkjet heads 41 to 44 perform printing by discharge ink droplets to the sheet 4. In this embodiment, the first to fourth inkjet heads 41 to 44 constitute "printing unit" in the present invention. Each of the first to fourth inkjet heads 41 to 44 includes a plurality of nozzles (not shown) arranged in the axial direction of the printing cylinder 14.

The ink drying lamp 45 irradiates the sheet 4 with infrared rays or ultraviolet rays. When ink applied to the sheet 4 by the first to fourth inkjet heads 41 to 44 is irradiated with infrared rays or ultraviolet rays, its temperature rises and the ink dries (solidifies).

The transfer mechanism 25 is provided near the periphery of the printing cylinder 14 on the downstream side of the ink drying lamp 45 in the sheet transfer direction. The transfer mechanism 25 is constituted using a plurality of transport cylinders. The plurality of transport cylinders are a first discharge-side transfer cylinder 46 that receives the sheet 4 from the printing cylinder 14 at a receiving position P2, a second discharge-side transfer cylinder 47 that receives the sheet 4 from the first discharge-side transfer cylinder 46, and a third discharge-side transfer cylinder 48 and a pre-reversal double-diameter cylinder 49 each of which receives the sheet 4 from the second discharge-side transfer cylinder 47.

The first discharge-side transfer cylinder 46, the second discharge-side transfer cylinder 47, the third discharge-side transfer cylinder 48, and the pre-reversal double-diameter cylinder 49 include sixth to ninth gripper devices 51 to 54 in order to hand over the sheet 4.

The arrangement of the sixth to ninth gripper devices 51 to 54 is the same as that of the second gripper device 27 of the supply-side transfer cylinder 24 and that of the third to fifth gripper devices 31 to 33 of the printing cylinder 14.

Of the sheets 4 received by the first discharge-side transfer cylinder 46 at the receiving position P2, the sheet 4 whose reverse surface undergoes printing passes through a reversing route 56 formed by the second discharge-side transfer cylinder 47, the pre-reversal double-diameter cylinder 49, and a reversing swing device 55 to be described later and is returned to the printing cylinder 14 in a reversed state.

On the other hand, the sheet 4 whose obverse surface undergoes printing alone or the sheet 4 that has undergone printing on both the obverse and reverse surfaces passes through a discharge route 58 formed by the second discharge-side transfer cylinder 47, the third discharge-side transfer cylinder 48, and a delivery belt 57 and is discharged to the delivery pile 6. The transfer mechanism 25 transfers the sheet 4 to either the discharge route 58 through which the sheet 4 is discharged or the reversing route 56 through which the sheet 4 is reversed.

The reversing swing device 55 is a device that feeds the sheet 4 from the pre-reversal double-diameter cylinder 49 to the printing cylinder 14, and is arranged between the pre-reversal double-diameter cylinder 49 and the supply-side transfer cylinder 24. The reversing swing device 55 includes a 10th gripper device 59 that grips the upstream end of the sheet 4 fed by the pre-reversal double-diameter cylinder 49 in the transfer direction. The reversing swing device 55 returns the sheet 4 held by the 10th gripper device 59 to the printing cylinder 14 at a return position P3 in a state in which the obverse surface faces the printing cylinder 14 (a state in which the sheet 4 is reversed).

<Explanation of Drive Connecting Means>

As shown in FIG. 2, the drive connecting means 16 for driving the feeder unit 2 includes a first power transmission route 61 used in single-sided printing and a second power transmission route 62 used in double-sided printing.

The first power transmission route 61 includes a first rotary shaft 63 that connects the drive device 15 and the feeder unit 2, and an electromagnetic clutch 64 provided at the intermediate portion of the first rotary shaft 63. The first rotary shaft 63 rotates in synchronism with the printing cylinder 14, the supply-side transfer cylinder 24, and the like.

The electromagnetic clutch 64 switches between a connection state in which power is transmitted from the drive device 15 to the feeder unit 2 via the first rotary shaft 63 and a disconnection state in which this power transmission is cut off. The electromagnetic clutch 64 can be, for example, a clutch that changes to the connection state upon energization and changes to the disconnection state upon canceling the energization state. The operation of the electromagnetic clutch 64 is controlled by a control device 65 that controls the operation of the printing apparatus 1.

Power is transmitted from the drive device 15 to the feeder unit 2 via the first power transmission route 61, and the suction device 11 and feeder board 12 of the feeder unit 2 operate at the first supply speed. The first supply speed is a speed at which the sheet 4 fed by the suction device 11 to the feeder board 12 reaches the front lays 22 in the first cycle. The first cycle corresponds to a cycle in which the rotating supply-side transfer cylinder 24 can grip the sheet 4 with respect to the third to fifth gripper devices 31 to 33 of the printing cylinder 14.

More specifically, when printing is performed on one surface of the sheet 4, the feeder unit 2 is driven at the first supply speed at which it supplies the sheets 4 to the printing cylinder 14 one by one continuously. In addition, the printing cylinder 14 is driven at a transfer speed at which the sheets 4 supplied from the feeder unit 2 one by one continuously are transferred.

The control device 65 is constituted by a CPU (Central Processing Unit). A printing mode select switch 66 and a rotary encoder 67 serving as a phase detector are connected to the control device 65, and the above-mentioned electromagnetic clutch 64, various actuators (not shown in FIG. 2), and the like are also connected.

The printing mode select switch 66 switches between a single-sided printing mode in which single-sided printing is performed in the printing apparatus 1 and a double-sided printing mode in which double-sided printing is performed.

The rotary encoder 67 detects the rotation phase of the printing cylinder 14. As shown in FIG. 2, the rotary encoder 67 is provided in the drive device 15.

The second power transmission route 62 includes a gear speed reducer 72 including a drive gear 71 provided on the first rotary shaft 63, and a one-way clutch 75 connected to a driven gear 73 of the speed reducer 72 via a second rotary shaft 74. In this embodiment, the second rotary shaft 74, the one-way clutch 75, and the above-described first rotary shaft 63 and electromagnetic clutch 64 correspond to "transmission member" in the present invention.

The driven gear 73 of the speed reducer 72 meshes with the drive gear 71 and rotates at ½ the rotating speed of the drive gear 71. In this embodiment, the speed reducer 72 corresponds to "speed switching means for the sheet supply unit" in the present invention.

The one-way clutch 75 transmits power from the second rotary shaft 74 to only the feeder unit 2. When the first rotary shaft 63 transmits power to the feeder unit 2, the feeder unit 2 side rotates at a speed higher than that of the second rotary shaft 74 and the one-way clutch 75 idles without transmitting power.

When the electromagnetic clutch 64 changes to the disconnection state, the second power transmission route 62 transmits power from the drive device 15 to the feeder unit 2. When the power is transmitted to the feeder unit 2 via the second power transmission route 62, the suction device 11 and feeder board 12 of the feeder unit 2 operate at the second supply speed that is ½ the first supply speed.

That is, when printing is performed on both surfaces of the sheet 4, the printing cylinder 14 is driven at the above-mentioned transfer speed and the feeder unit 2 is driven at the second supply speed that is ½ the first supply speed.

<Arrangement of Register Unit>

Figure 9:
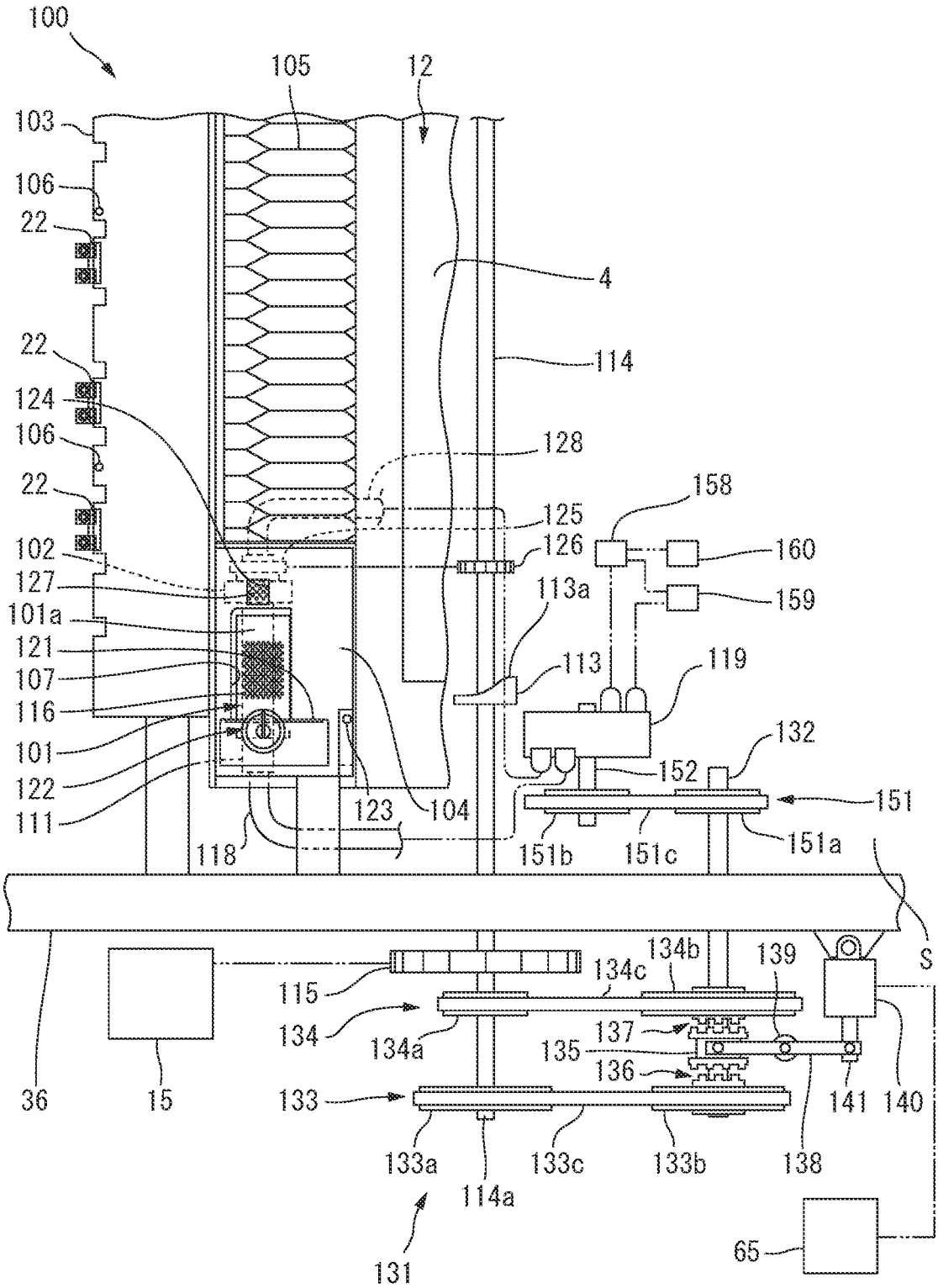
FIG. 9 is a plan view for explaining the arrangement of a register unit.

While supplying the sheet 4 from the feeder unit 2 to the printing cylinder 14, the register unit 100 adjusts a position of the sheet 4 in the transfer direction and a position in the lateral direction that is a horizontal direction perpendicular to the transfer direction. As shown in FIG. 9, the register unit 100 includes the front lays 22 arranged at a downstream end in the sheet transfer direction (the left direction in FIG. 9), a side lay 101 arranged on the upstream side of the front lays 22 in the sheet transfer direction and on one side (left side) in the lateral direction, and a plurality of forced front lay wheels 102 provided at the same position as the side lay 101 in the sheet transfer direction. FIG. 9 shows the side lay 101 and only the forced front lay wheel 102 adjacent to the side lay 101.

The front lays 22 are provided at positions adjacent to the downstream end of a feedboard 103. The feedboard 103 is formed from a plate extending in the sheet transfer direction and the lateral direction, is supported by the frames 35 and 36, and forms part of a sheet transfer path between the feeder board 12 and the swing arm shaft pregripper 23. Note that the frame 35 is not illustrated in FIG. 9.

Side lay feedboards 104 and sheet guides 105 are provided between the feedboard 103 and the feeder board 12. The side lay feedboards 104 are arranged on two sides adjacent to the frames 35 and 36 in the lateral direction and at a center between the frames 35 and 36 in the lateral direction, and are supported by the frames 35 and 36. The sheet guides 105 are formed to be stretchable in the lateral direction and provided between the left side lay feedboard 104 and the center side lay feedboard (not shown) and between the center side lay feedboard and the right side lay feedboard (not shown).

The front lays 22 move between a projection position shown in FIG. 9 and a lower retreat position (not shown). In a state in which the front lays 22 are located at the projection position, the leading edge of the sheet 4 moving along the feedboard 103 abuts against the front lays 22. In a state in which the front lays 22 are located at the retreat position, the front lays 22 do not obstruct transfer of the sheet 4 by the swing arm shaft pregripper 23. The front lays 22 are moved by power of the drive device 15 in synchronism with the swing arm shaft pregripper 23.

A plurality of sheet sensors 106 are attached to the downstream end of the feedboard 103. The sheet sensors 106 are optical sensors that irradiate the lower surface of the sheet 4 from below it and detect the presence/absence of light reflected by the sheet 4. The sheet sensors 106 are provided on the feedboard 103 in a state in which they are aligned at a predetermined interval in the lateral direction.

The sheet sensors 106 are connected to the control device 65 and send detection results as signals to the control device 65. The transfer state of the sheet 4 (the presence/absence of the sheet 4 and out of square of the sheet 4) can be detected by detecting the sheet 4 by the plurality of sheet sensors 106 on the feedboard 103 side.

Figure 10:
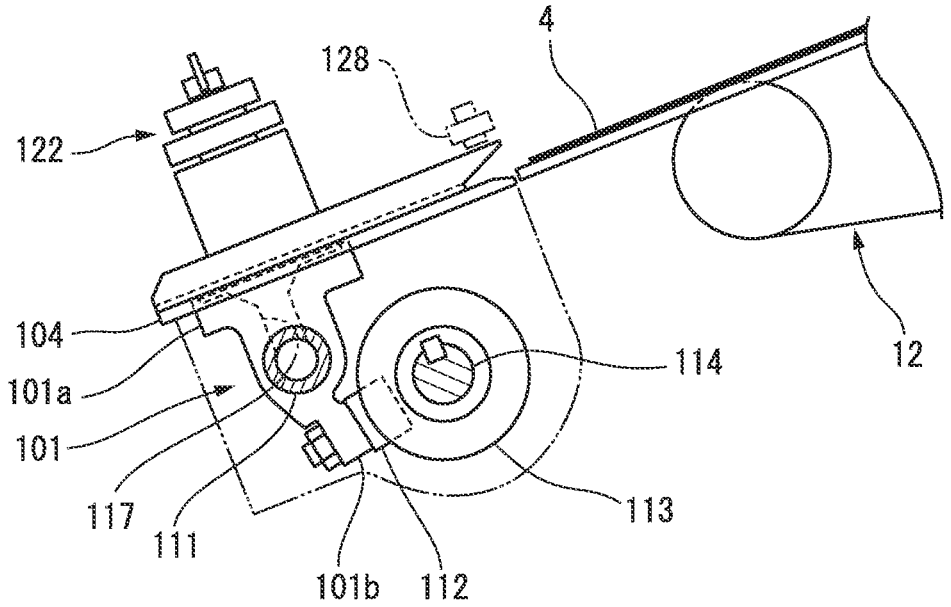
FIG. 10 is a side view of a side lay and the end of a feeder board.

The side lay 101 has a suction portion 101*a* exposed from a first hole 107 formed in the left side lay feedboard 104, and is supported movably in the axial direction by a side lay support shaft 111 located near the side lay feedboard 104. The side lay support shaft 111 is fixed to the frame 36 in a state in which it extends in the lateral direction. As shown in FIG. 10, the side lay 101 has an arm portion 101*b* projecting below from the side lay support shaft 111. A cam follower 112 formed from a roller is rotatably attached to the arm portion 101*b*. The cam follower 112 is pressed against a cam surface 113*a* (see FIG. 9) of a side lay drive cam 113 by the spring force of a spring member (not shown). The side lay drive cam 113 is formed into a disk shape and fixed to a side lay drive shaft 114.

As shown in FIG. 9, the side lay drive shaft 114 is rotatably supported by bearings (not shown) on the pair of left and right frames 35 and 36 in a state in which it is bridged between the frames 35 and 36. A driven gear 115 is attached to one end of the side lay drive shaft 114 that projects outside the printing apparatus 1 from the frame 36. The driven gear 115 receives power from the drive device 15 and rotates in synchronism with the printing cylinder 14, the swing arm shaft pregripper 23, and the like.

The cam surface 113*a* of the side lay drive cam 113 is formed on one end face of the cam 113 in the axial direction. While the cam follower 112 is in contact with the cam surface 113*a*, the side lay drive shaft 114 rotates together with the driven gear 115 and the side lay 101 reciprocates in the lateral direction along the side lay support shaft 111. More specifically, the side lay 101 moves to the left side, which is a direction in which the side lay 101 comes close to a side lay stopper 121 to be described later, in the process of swinging the swing arm shaft pregripper 23 toward the feedboard 103. The side lay 101 moves to the right side, which is a direction in which the side lay 101 moves apart from the side lay stopper 121, in the process of gripping the sheet 4 by the first gripper device 26 and transferring the sheet 4 by the swing arm shaft pregripper 23 toward the supply-side transfer cylinder 24.

As shown in FIG. 9, many air vents 116 are formed in the suction portion 101*a* of the side lay 101. The air vents 116 are connected to a rotary air valve 119 to be described later via an air passage 117 (see FIG. 10) formed inside the side lay 101 and the side lay support shaft 111 and via a first hose 118 (see FIG. 9) having one end connected to the side lay 101.

The side lay stopper 121 is provided on the upper surface of the left side lay feedboard 104 having the side lay 101 on the left side of the suction portion 101*a* of the side lay 101. The left edge of the sheet 4 abuts against the side lay stopper 121 to adjust the lateral position of the sheet 4. The side lay stopper 121 includes an adjustor 122 that adjusts the lateral position of the side lay stopper 121 with respect to the side lay feedboard 104.

A sheet sensor 123 is provided on the upstream side of the side lay stopper 121 in the sheet transfer direction on the left side lay feedboard 104. The sheet sensor 123 is an optical sensor that irradiates the upper surface of the sheet 4 from above it and detects the presence/absence of light reflected by the sheet 4. The sheet sensor 123 is connected to the control device 65 and sends a detection result as a signal to the control device 65. An error of adjustment by the side lay 101 can be detected using the sheet sensor 123 on the side lay feedboard side.

Figure 16:
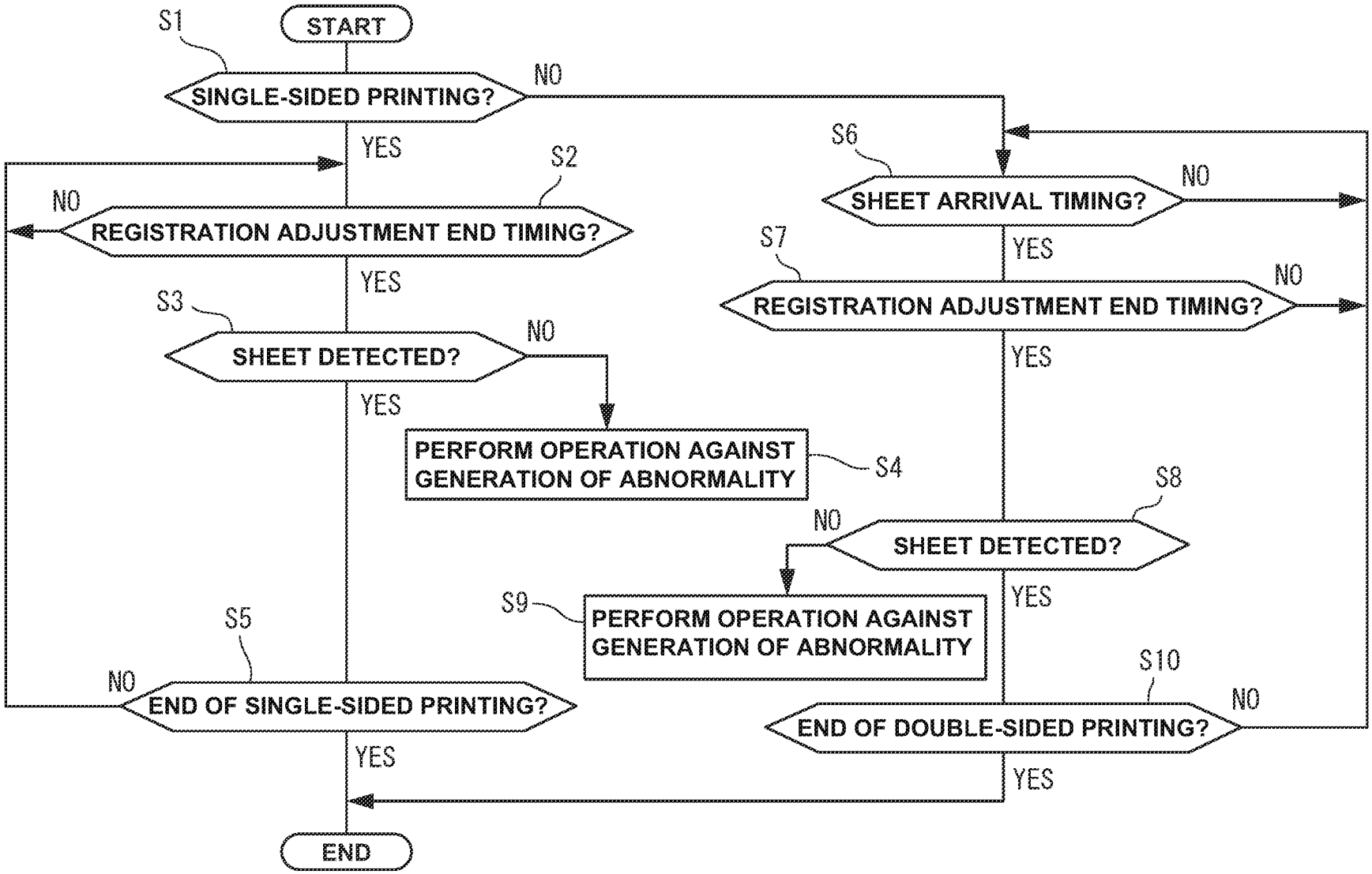
FIG. 16 is a flowchart for explaining the operation of the sensor of the register unit.

The control device 65 detects the presence/absence of the sheet 4 using the sheet sensors 106 on the feedboard 103 side and the sheet sensor 123 on the side lay feedboard 104 side based on procedures described in the flowchart shown in FIG. 16. When the sheet sensors 106 and 123 cannot detect the sheet 4 at the timing when the sheet 4 should exist, the control device 65 executes an operation in advance against generation of an abnormality. If this operation is performed, for example, a warning device (not shown) operates and the drive device 15 stops. The flowchart shown in FIG. 16 will be explained later.

A second hole 124 is formed on the right side of the first hole 107 in the left side lay feedboard 104. Part of the forced front lay wheel 102 is exposed from the second hole 124. The forced front lay wheel 102 is provided for every side lay feedboard 104 and provided rotatably on the same axis as that of the side lay support shaft 111. Each forced front lay wheel 102 has a driven gear 125. The driven gear 125 meshes with a wheel drive gear 126 of the side lay drive shaft 114.

Many air vents 127 are formed in the outer peripheral surface of the forced front lay wheel 102. The air vents 127 are connected to the rotary air valve 119 to be described later via an air passage (not shown) inside the forced front lay wheel 102 and a second hose 128.

The rotary air valve 119 is connected via a valve drive device 131 to a shaft end 114*a* of the side lay drive shaft 114 that projects outside from an inner apparatus space S between the frames 35 and 36.

The valve drive device 131 includes an intermediate shaft 132 parallel to the side lay drive shaft 114. The intermediate shaft 132 is rotatably supported by a bearing (not shown) on the frame 36 in a state in which it extends through the frame 36.

First and second transmission mechanisms 133 and 134 are provided between the side lay drive shaft 114 and the intermediate shaft 132. The first transmission mechanism 133 includes a first drive sprocket 133*a* fixed to the shaft end of the side lay drive shaft 114, a first driven sprocket 133*b* movably supported by the shaft end of the intermediate shaft 132, and a first chain 133*c* wound around the sprockets 133*a* and 133*b*. The first transmission mechanism 133 transmits rotation of the side lay drive shaft 114 to the intermediate shaft 132 so that the rotating speed of the side lay drive shaft 114 coincides with that of the intermediate shaft 132.

The second transmission mechanism 134 includes a second drive sprocket 134*a* fixed between the first drive sprocket 133*a* of the side lay drive shaft 114 and the driven gear 115, a second driven sprocket 134*b* movably supported between the first driven sprocket 133*b* of the intermediate shaft 132 and the frame 36, and a second chain 134*c* wound around the sprockets 134*a* and 134*b*. The second transmission mechanism 134 transmits rotation of the side lay drive shaft 114 to the intermediate shaft 132 so that the rotating speed of the intermediate shaft 132 becomes ½ the rotating speed of the side lay drive shaft 114.

A slide rotating part 135 is provided between the first driven sprocket 133*b* and the second driven sprocket 134*b* on the intermediate shaft 132. The slide rotating part 135 is supported movably in the axial direction by the intermediate shaft 132 in a state in which its relative rotation is restricted with respect to the intermediate shaft 132.

A first jaw clutch 136 is provided between one shaft end of the slide rotating part 135 and a shaft end of the first driven sprocket that faces the shaft end of the slide rotating part 135. A second jaw clutch 137 is provided between the other shaft end of the slide rotating part 135 and a shaft end of the second driven sprocket 134*b* that faces the other shaft end.

One end of a switching lever 138 is connected to the outer periphery of the slide rotating part 135. One end of the switching lever 138 is connected to the slide rotating part 135 so that it becomes rotatable with respect to the slide rotating part 135 and movable in the axial direction together with the slide rotating part 135. The switching lever 138 is swingably supported by a spindle 139 at the intermediate portion of the switching lever 138. The spindle 139 is fixed to the frame 36. The other end of the switching lever 138 is pivotably connected to a piston rod 141 of an air cylinder 140. The air cylinder 140 is swingably supported by the frame 36.

The operation of the air cylinder 140 is controlled by the control device 65. The piston rod 141 of the air cylinder 140 according to this embodiment retracts in the single-sided printing mode. When the piston rod 141 retracts, the first driven sprocket 133*b* and the slide rotating part 135 are connected via the first jaw clutch 136 and the intermediate shaft 132 rotates at the same rotating speed as that of the side lay drive shaft 114. In the double-sided printing mode, the piston rod 141 advances, and the second driven sprocket 134*b* and the slide rotating part 135 are connected via the second jaw clutch 137. In this case, the intermediate shaft 132 rotates at ½ the rotating speed of the side lay drive shaft 114.

The valve drive device 131 is constituted by the above-described intermediate shaft 132, first and second transmission mechanisms 133 and 134, slide rotating part 135 including the first and second jaw clutches 136 and 137, air cylinder 140 that drives the slide rotating part 135, and the like. In this embodiment, the valve drive device 131 corresponds to "operation switching means for the register unit" in the present invention.

A valve drive shaft 152 of the rotary air valve 119 is connected via a third transmission mechanism 151 to a portion of the intermediate shaft 132 that is located in the inner apparatus space S. The third transmission mechanism 151 includes a third drive sprocket 151*a* fixed to the intermediate shaft 132, a third driven sprocket 151*b* fixed to the valve drive shaft 152, and a third chain 151*c* wound around the sprockets 151*a* and 151*b*. The third transmission mechanism 151 transmits rotation of the intermediate shaft 132 to the valve drive shaft 152 so that the rotating speed of the intermediate shaft 132 coincides with that of the valve drive shaft 152.

Figure 11:
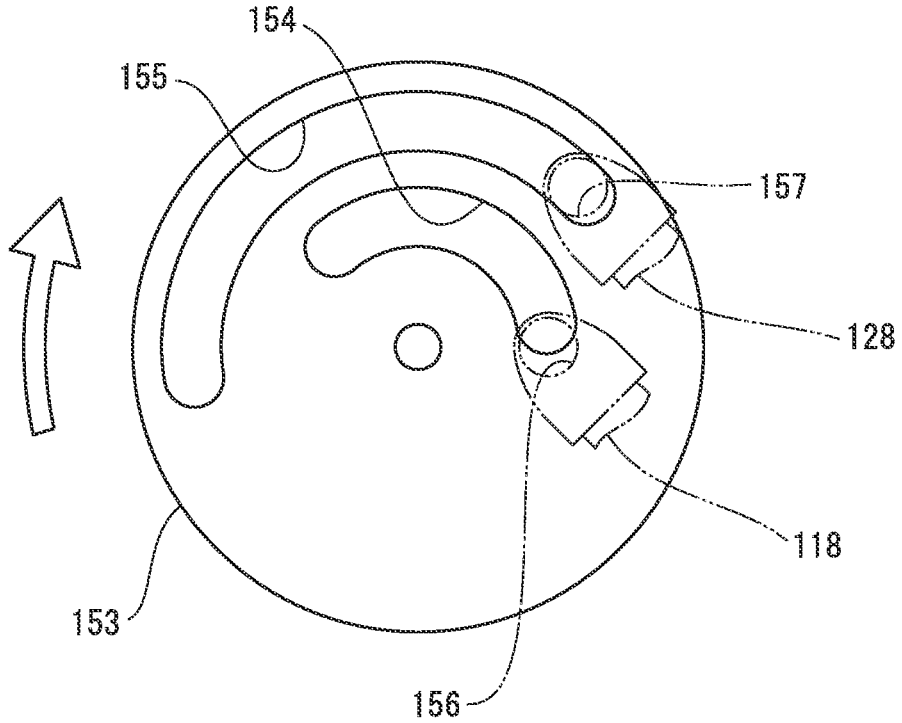
FIG. 11 is a front view of the valve body of a rotary air valve used in the register unit.

The rotary air valve 119 includes a valve body 153 shown in FIG. 11. The valve body 153 is formed into a disk shape and fixed to the valve drive shaft 152 in a state in which it is located on the same axis as that of the valve drive shaft 152. Arcuate first and second notches 154 and 155 are formed in the valve body 153. The centers of the arcs forming the first and second notches 154 and 155 coincide with the shaft center of the valve body 153. The first notch 154 is formed between the second notch 155 and the valve body 153 in a shape in which its length in the rotating direction of the valve body 153 becomes smaller than that of the second notch 155.

The rotary air valve 119 according to this embodiment includes first and second air chambers (not shown) formed on one side (back side of the sheet surface of FIG. 11) with respect to the valve body 153, and first and second communication ports 156 and 157 formed on the other side (front side of the sheet surface of FIG. 11). The first air chamber is formed at a position where it faces the first notch 154, and is connected to a negative pressure source 159 and a positive pressure source 160 via a switching valve 158 (see FIG. 9). The switching valve 158 connects either the negative pressure source 159 or the positive pressure source 160 to the first air chamber. The operation of the switching valve 158 is controlled by the control device 65. The second air chamber is formed at a position where it faces the second notch 155, and is connected to the negative pressure source 159.

The first communication port 156 is connected at a position where it faces the first notch 154. The other end of the first hose 118 having one end connected to the side lay 101 is connected to the first communication port 156. When the valve body 153 rotates and the first notch 154 overlaps the first communication port 156, the air passage 117 in the side lay 101 is connected to the negative pressure source 159 or the positive pressure source 160 via the first hose 118, the rotary air valve 119, and the switching valve 158. The first communication port 156 communicates with the first notch 154 when the side lay 101 moves toward the side lay stopper 121.

The air passage 117 in the side lay 101 is connected to the negative pressure source 159 to draw air into the air vents 116 of the side lay 101. At this time, when the sheet 4 is located on the side lay 101, it is sucked by the side lay 101, moves together with the side lay 101, and abuts against the side lay stopper 121. As a result, the registration of the sheet 4 in the lateral direction is adjusted.

The second communication port 157 is formed at a position where it faces the second notch 155. The other end of the second hose 128 having one end connected to the forced front lay wheel 102 is connected to the second communication port 157. When the valve body 153 rotates and the second notch 155 overlaps the second communication port 157, the air passage in the forced front lay wheel 102 is connected to the negative pressure source 159 via the second hose 128 and the rotary air valve 119.

The air passage in the forced front lay wheel 102 is connected to the negative pressure source 159 to draw air into the air vents 127 of the forced front lay wheel 102. At this time, when the sheet 4 is located on the forced front lay wheel 102, it is sucked by the forced front lay wheel 102, pushed toward the downstream side in the transfer direction by the rotating forced front lay wheel 102, and abuts against the front lays 22. As a result, the registration of the sheet 4 in the transfer direction is adjusted.

The cycle in which the first and second communication ports 156 and 157 communicate with the first and second notches 154 and 155 is different between single-sided printing and double-sided printing. This is because the first transmission mechanism 133 is used in single-sided printing and the second transmission mechanism 134 is used in double-sided printing. In single-sided printing, the first and second communication ports 156 and 157 communicate with the first and second notches 154 and 155 every time the swing arm shaft pregripper 23 reciprocates once. In double-sided printing, the first and second communication ports 156 and 157 communicate with the first and second notches 154 and 155 every time the swing arm shaft pregripper 23 reciprocates twice.

The first notch 154 is connected to the first communication port 156 while the swing arm shaft pregripper 23 swings toward the feedboard 103. The state of communication between the first notch 154 and the first communication port 156 ends immediately before the first gripper device 26 of the swing arm shaft pregripper 23 grips the sheet 4 and the swing arm shaft pregripper 23 starts to swing toward the supply-side transfer cylinder 24. Immediately when the first notch 154 is connected to the first communication port 156, the negative pressure source 159 is connected to the first air chamber. However, immediately after the first gripper device 26 grips the sheet 4, the switching valve 158 is switched and the positive pressure source 160 is connected to the first air chamber. After a positive air pressure is transmitted to the air vents 116, the state of communication between the first notch 154 and the first communication port 156 ends.

The second notch 155 is connected to the second communication port 157 when the swing arm shaft pregripper 23 starts to swing from the supply-side transfer cylinder 24 side toward the feedboard 103. The state of communication between the second notch 155 and the second communication port 157 ends immediately before the first gripper device 26 grips the sheet 4 and the swing arm shaft pregripper 23 starts to swing toward the supply-side transfer cylinder 24.

<Explanation of Operation>

When the single-sided printing mode is selected with the printing mode select switch 66, the printing apparatus 1 having this arrangement operates to perform printing on only one surface of the sheet 4. At this time, the control device 65 determines in step S1 of the flowchart shown in FIG. 16 that the printing mode is the single-sided printing mode, and waits in next step S2 for the timing when registration adjustment ends in the register unit 100. This timing is detected based on detection data of the rotary encoder 67.

<Explanation of Operation in Single-Sided Printing>

In single-sided printing, the electromagnetic clutch 64 of the drive connecting means 16 provided in the feeder unit 2 changes to the "connection state", and power is transmitted from the drive device 15 to the feeder unit 2 via the first power transmission route 61. In this case, the suction device 11 moves by only a distance B from the pickup position to the release position or from the release position to the pickup position every time the swing arm shaft pregripper 23 swings to one or the other side, as indicated by two-dot chain lines in FIGS. 5 to 8.

Also, in single-sided printing, the air cylinder 140 is controlled by the control device 65, the piston rod 141 retracts, and the side lay drive shaft 114 and the intermediate shaft 132 are connected via the first transmission mechanism 133. The valve body 153 of the rotary air valve 119 rotates once every time the swing arm shaft pregripper 23 reciprocates once. A negative pressure acts on the air vents 116 of the side lay 101 and the air vents 127 of the forced front lay wheel 102 every time the swing arm shaft pregripper 23 comes close to the feedboard 103 (every time the side lay 101 moves toward the side lay stopper 121).

The sheet 4 placed on the feeder board 12 by the suction device 11 is transferred in a state in which it lags from the preceding sheet 4 by a length A toward the upstream side in the transfer direction, as indicated by the two-dot chain lines in FIGS. 5 to 8. The sheet 4 fed from the feeder board 12 to the side lay feedboard 104 side is sucked by the forced front lay wheel 102, forcedly fed toward the downstream side in the transfer direction along with rotation of the forced front lay wheel 102, and abuts against the front lays 22. That is, registration of the sheet 4 in the transfer direction is adjusted. As shown on the left side in FIG. 12, the sheet 4 is sucked by the side lay 101, slides to the left together with the side lay 101, and abuts against the side lay stopper 121. In this manner, the sheet 4 abuts against the side lay stopper 121 to adjust registration of the sheet 4 in the lateral direction.

After the end of registration adjustment, the control device 65 executes step S3 of the flowchart shown in FIG. 16 to determine whether all the sheet sensors 106 and 123 have detected the sheet 4. If there is the sheet sensor 106 or 123 that has not detected the sheet 4, the process advances to step S4 and the control device 65 performs an operation against generation of an abnormality. The operation against generation of an abnormality is to operate the warning device or to stop the drive device 15. If all the sheet sensors 106 and 123 have detected the sheet 4, the process advances to step S5 to determine whether the single-sided printing mode has ended. The control device 65 repeats the above-described operation till the end of the single-sided printing mode, and then ends the control operation.

After it is confirmed that all the sheet sensors 106 and 123 have detected the sheet 4, the swing arm shaft pregripper 23 swings to the receiving position (see FIGS. 5, 7, 12, and 14) and the sheet 4 on the feedboard 103 is gripped by the first gripper device 26 of the swing arm shaft pregripper 23. When or immediately after the first gripper device 26 grips the sheet 4, air of a positive pressure is supplied to the air passage 117 in the side lay 101 and the suction state of the sheet 4 is canceled. Immediately before the swing arm shaft pregripper 23 starts to swing toward the supply-side transfer cylinder 24, the suction state of the sheet 4 is canceled even at the forced front lay wheel 102.

The front lays 22 move to the retreat position, the swing arm shaft pregripper 23 starts to swing toward the handover position (see FIGS. 6 and 8), and the sheet 4 is fed from the feeder board 12 to the supply-side transfer cylinder 24 side.

Figure 13:
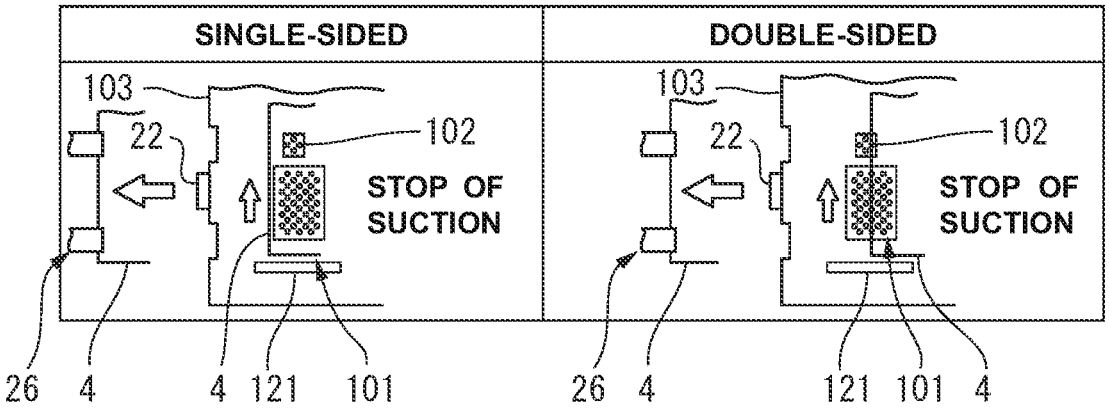
FIG. 13 is a schematic view for explaining the operation of the register unit.
Figure 15:
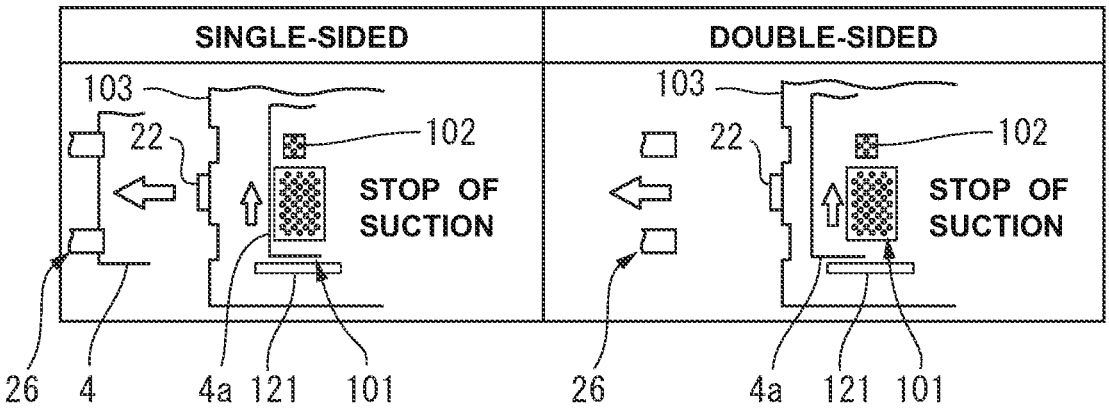
FIG. 15 is a schematic view for explaining the operation of the register unit.

As shown in FIGS. 13 and 15, the side lay 101 returns to the initial position in the process in which the swing arm shaft pregripper 23 swings toward the supply-side transfer cylinder 24. At this time, suction of air is stopped at the air vents 116 of the side lay 101 and the air vents 127 of the forced front lay wheel 102.

Every time the supply-side transfer cylinder 24 rotates once, the second gripper device 27 of the supply-side transfer cylinder 24 receives the sheet 4 from the first gripper device 26 of the swing arm shaft pregripper 23. The sheet 4 is handed over from the second gripper device 27 to one of the third to fifth gripper devices 31 to 33 of the printing cylinder 14. That is, the sheets 4 are supplied from the feeder unit 2 to the printing cylinder 14 one by one continuously. The printing cylinder 14 transfers one by one continuously the sheets 4 fed from the feeder unit 2.

The sheet 4 transferred to the printing cylinder 14 undergoes printing by the first to fourth inkjet heads 41 to 44. The sheet 4 is transferred through a position where it faces the ink drying lamp 45, and ink applied to the sheet 4 by printing is solidified. The sheet 4 having undergone printing on one surface is transferred by the first discharge-side transfer cylinder 46, the second discharge-side transfer cylinder 47, and the third discharge-side transfer cylinder 48, and discharged to the delivery belt 57. The printed sheet 4 is discharged to the delivery pile 6 by the delivery belt 57.

<Explanation of Operation in Double-Sided Printing>

When the double-sided printing mode is selected with the printing mode select switch 66, the printing apparatus 1 operates to perform printing on both surfaces of the sheet 4. At this time, the control device 65 advances from step S1 of the flowchart shown in FIG. 16 to step S6 and waits till the sheet arrival timing. The sheet arrival timing is the timing when the sheet 4 arrives at the vicinity of the downstream end of the feedboard 103. This timing is detected based on detection data of the rotary encoder 67.

In double-sided printing, the electromagnetic clutch 64 of the drive connecting means 16 provided in the feeder unit 2 changes to the "disconnection state", and power is transmitted from the drive device 15 to the feeder unit 2 via the second power transmission route 62. In this case, the feeder unit 2 is driven at the second supply speed. At this time, the suction device 11 operates at the second supply speed that is ½ the first supply speed in single-sided printing, and reciprocates once every time the swing arm shaft pregripper 23 reciprocates twice, as indicated by solid lines in FIGS. 5 to 8.

The sheet 4 placed on the feeder board 12 by the suction device 11 in double-sided printing is transferred at ½ the moving speed in single-sided printing because the supply speed of the feeder board 12 is also decreased to ½ the supply speed in single-sided printing. As a result, the sheet 4 placed on the feeder board 12 by the suction device 11 takes the same transfer form as that in single-sided printing, and is transferred in a state in which the sheet 4 lags from the preceding sheet 4 by the length A, as indicated by the solid lines in FIGS. 5 to 8. This means that the width of the overlapping portion of the sheets 4 is equal between single-sided printing and double-sided printing.

Figure 6:
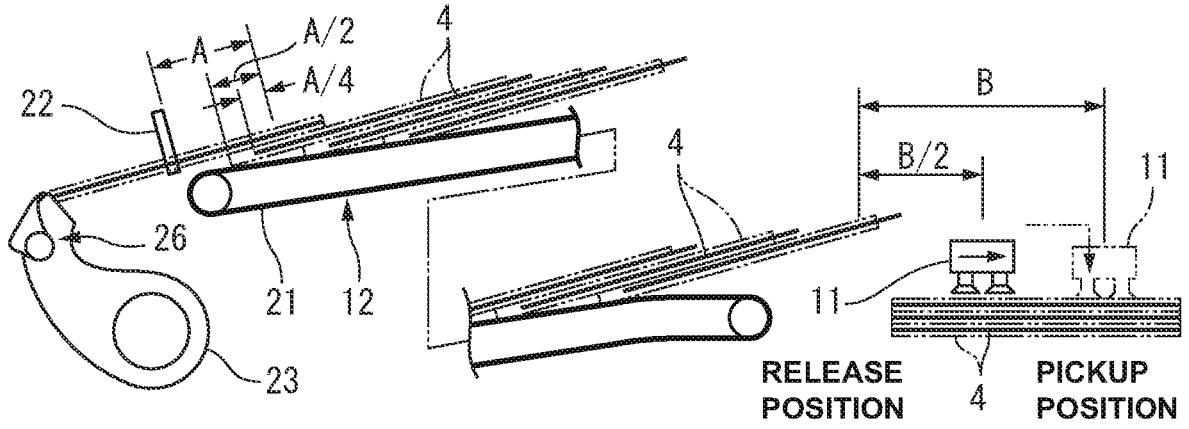
FIG. 6 is a schematic view for explaining the operation of the sheet supply unit.
Figure 7:
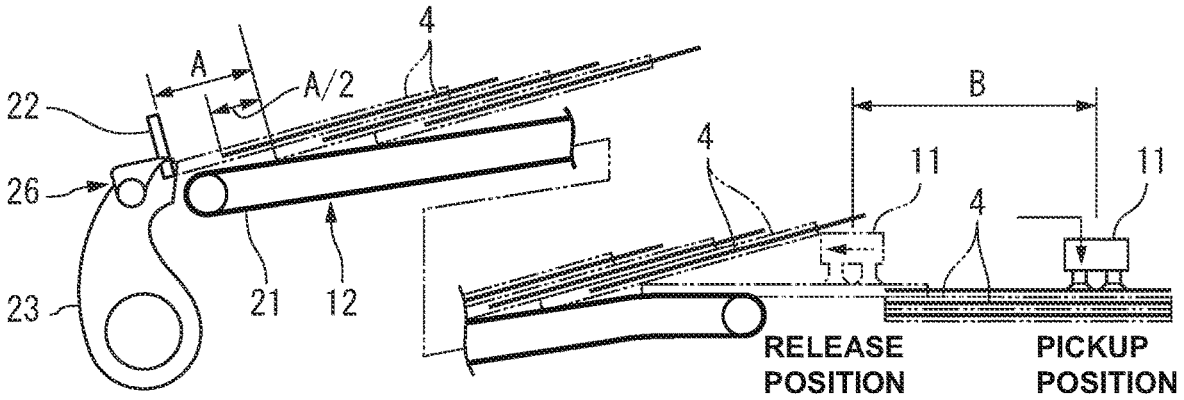
FIG. 7 is a schematic view for explaining the operation of the sheet supply unit.
Figure 8:
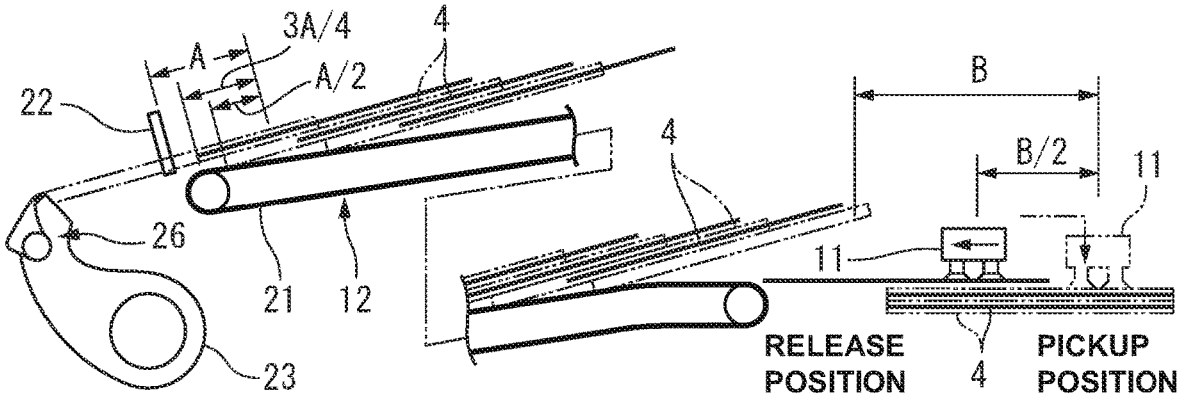
FIG. 8 is a schematic view for explaining the operation of the sheet supply unit.

However, the supply speed of the feeder board 12 is decreased to ½ the supply speed in single-sided printing, so the moving distance of the sheet 4 in double-sided printing is ½ the moving distance in single-sided printing. In single-sided printing, the sheet 4 indicated by the two-dot chain line advances by only A/2 in the process in which the swing arm shaft pregripper 23 swings from the receiving position to the handover position, as shown in FIGS. 5 and 6. However, the moving distance of the sheet 4 in double-sided printing indicated by the solid line in this process is A/4.

Hence, in double-sided printing, there is one "idle reciprocation process" in which the swing arm shaft pregripper 23 swings from the feedboard 103 toward the supply-side transfer cylinder 24 without gripping the sheet 4 while the swing arm shaft pregripper 23 reciprocates twice. Every time the swing arm shaft pregripper 23 reciprocates twice, only one new sheet 4 is fed from the feeder board 12 to the supply-side transfer cylinder 24. The new sheet 4 is supplied from the feeder unit 2 to every other transfer surface 28 out of the transfer surfaces 28 at three portions on the printing cylinder 14.

<Explanation of Operation of Register Unit in Double-Sided Printing>

Figure 12:
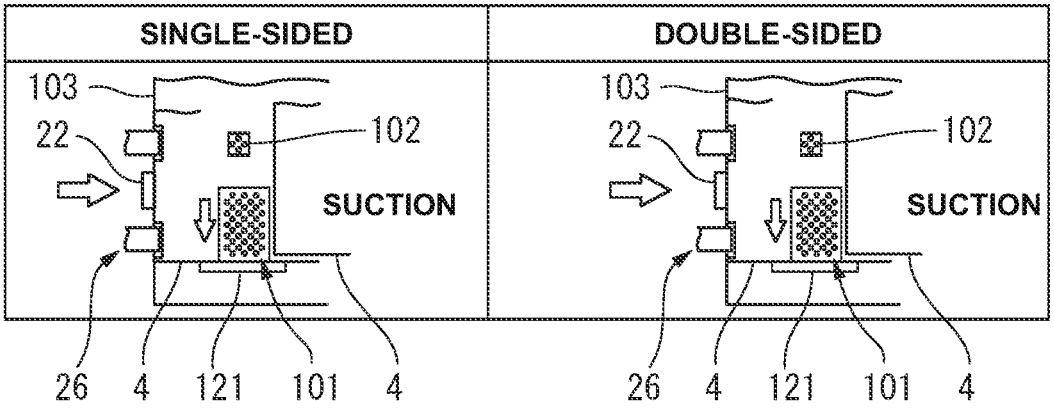
FIG. 12 is a schematic view for explaining the operation of the register unit.

In double-sided printing, the register unit 100 performs the same operation as that in single-sided printing when the sheet 4 is fed to the vicinity of the downstream end of the feedboard 103, that is, at the sheet arrival timing, as represented on the right side in FIGS. 12 and 13.

In double-sided printing, the air cylinder 140 of the valve drive device 131 is controlled by the control device 65, the piston rod 141 advances, and the side lay drive shaft 114 and the intermediate shaft 132 are connected via the second transmission mechanism 134. In double-sided printing, the valve body 153 of the rotary air valve 119 rotates at ½ the rotating speed in single-sided printing. Resultantly, a negative pressure acts only once on the air vents 116 of the side lay 101 and the air vents 127 of the forced front lay wheel 102 every time the swing arm shaft pregripper 23 reciprocates twice (every time the side lay 101 reciprocates twice). More specifically, when the swing arm shaft pregripper 23 is in the above-mentioned "idle reciprocation process", no negative pressure acts on the air vents 116 of the side lay 101 and the air vents 127 of the forced front lay wheel 102.

When the sheet 4 is transferred to the vicinity of the downstream end of the feedboard 103 in double-sided printing, the control device 65 advances from step S6 of the flowchart shown in FIG. 16 to step S7 and waits for the timing when registration adjustment ends. First, the sheet 4 transferred to the vicinity of the downstream end of the feedboard 103 is sucked by the forced front lay wheel 102, forcedly fed, and abuts against the front lays 22, similar to single-sided printing. Then, the sheet 4 is sucked by the side lay 101, slides, and abuts against the side lay stopper 121, as represented on the right side in FIG. 12.

After the end of registration adjustment of the sheet 4, the control device 65 executes step S8 of the flowchart shown in FIG. 16. That is, the control device 65 determines whether the plurality of sheet sensors 106 on the feedboard 103 side and the sheet sensor 123 on the side lay feedboard 104 side have detected the sheet 4. If there is the sheet sensor 106 or 123 that has not detected the sheet 4, the process advances to step S9 and the control device 65 performs the same operation against generation of an abnormality as the operation performed in step S4. If all the sheet sensors 106 and 123 have detected the sheet 4, the process advances to step S10 to determine whether the double-sided printing mode has ended. The control device 65 repeats the above-described operation till the end of the double-sided printing mode, and then ends the control operation.

When registration adjustment of the sheet 4 ends and the result of abnormality determination using the sheet sensors 106 is satisfactory, the sheet 4 is transferred by the swing arm shaft pregripper 23, as represented on the right side in FIG. 13. At this time, the side lay 101 returns to the initial position in a state in which suction of air is stopped.

Figure 14:
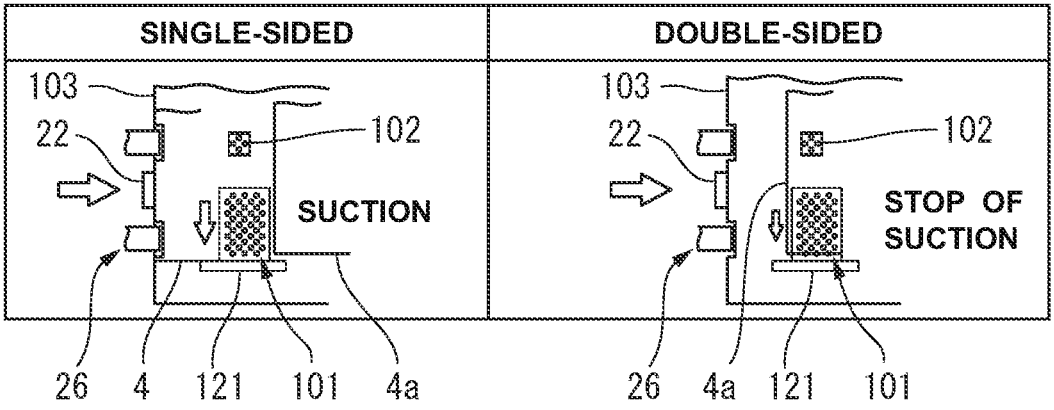
FIG. 14 is a schematic view for explaining the operation of the register unit.

After that, the side lay 101 moves toward the side lay stopper 121, as shown in FIG. 14, in the process (idle reciprocation process) in which the swing arm shaft pregripper 23 hands over the sheet 4 to the supply-side transfer cylinder 24 and swings toward the feedboard 103. In single-sided printing, the side lay 101 sucks and slides a next sheet 4*a* in a state in which the sheet 4*a* abuts against the front lays 22 in this process, as represented on the left side in FIG. 14.

However, in double-sided printing, the transfer speed of the sheet 4 is ½ the transfer speed in single-sided printing, so the leading edge of the next sheet 4*a* does not reach the vicinity of the downstream end of the feedboard 103 and is located on the side lay 101 side, as represented on the right side in FIG. 14. If the next sheet 4*a* is sucked by the side lay 101 before abutting against the front lays 22, the sheet 4*a* may be tilted and transferred or the leading edge of the sheet 4*a* may be erroneously gripped by the first gripper device 26 of the swing arm shaft pregripper 23 in the idle reciprocation process, and a transfer error may be generated. According to this embodiment, however, the negative pressure source 159 is connected to neither the side lay 101 nor the forced front lay wheel 102 in the "idle reciprocation process", and the next sheet 4*a* moves straight toward the downstream end of the feedboard 103, as represented on the right side in FIG. 15.

As represented on the right side in FIG. 14, when the swing arm shaft pregripper 23 comes close to the feedboard 103 in the "idle reciprocation process", the control device 65 determines in step S6 of the flowchart shown in FIG. 16 that the sheet arrival timing has not come. Even if the sheet sensors 106 and 123 cannot detect the next sheet 4*a* immediately before the swing arm shaft pregripper 23 reaches the receiving position, the control device 65 does not determine this state as generation of an abnormality.

The new sheet 4 fed from the supply-side transfer cylinder 24 to the printing cylinder 14 in double-sided printing passes through the first to fourth inkjet heads 41 to 44 and the position where the sheet 4 faces the ink drying lamp 45, and is fed from the first discharge-side transfer cylinder 46 to the pre-reversal double-diameter cylinder 49 via the second discharge-side transfer cylinder 47. The sheet 4 is reversed by the reversing swing device 55 and returned to the printing cylinder 14 at the return position P3. After printing is performed on an unprinted surface, the sheet 4 is discharged to the delivery pile 6 by the first to third discharge-side transfer cylinders 46 to 48 and the delivery belt 57.

Explanation of Effect of First Embodiment

In the printing apparatus 1 having the above-described arrangement, when printing is performed on both surfaces of the sheet 4, the supply speed of the feeder unit 2 changes to ½ the supply speed in single-sided printing, and the sheet 4 is supplied to the printing cylinder 14 at double the supply interval used when supplying the sheet 4 in single-sided printing. In double-sided printing, the sheets 4 can be supplied continuously at an interval necessary for supply of the sheets 4 on the printing cylinder 14 without intermittently transferring the sheets 4 from the feeder unit 2. In double-sided printing, the sheets 4 can be supplied in the same supply form as that in single-sided printing.

According to this embodiment, the printing apparatus that operates stably in both single-sided printing and double-sided printing can be provided.

According to this embodiment, a complicated arrangement to control the air pressure is obviated and the arrangement of the air pressure control system is simplified, compared to the printing apparatus described in patent literature 1, that is, the printing apparatus that supplies the sheets 4 intermittently in double-sided printing.

The feeder unit 2 according to this embodiment is a stream feeder that transfers the plurality of sheets 4 in a state in which they partially overlap each other in the transfer direction. In this embodiment, the width of the overlapping portion of the sheets 4 is equal between single-sided printing and double-sided printing, so the magnitude of a thrust applied to the sheet 4 abutting against the front lays 22 is equal between single-sided printing and double-sided printing. According to this embodiment, the printing apparatus in which no transfer error is generated in the feeder unit can be provided.

The printing apparatus 1 according to this embodiment includes the drive device 15 that drives the printing cylinder 14, and the drive connecting means 16 that transmits power from the drive device 15 to the feeder unit 2 via the transmission member and the speed reducer 72. In this embodiment, the "speed switching means" in the present invention is constituted by the speed reducer 72.

Since the drive device 15 that drives the printing cylinder 14 serves as the power source of the feeder unit 2, synchronization between the feeder unit 2 and the printing cylinder 14 can be achieved easily. The printing apparatus with high precision of the timing when the sheet 4 is supplied to the printing cylinder 14 can be provided.

The printing apparatus 1 according to this embodiment includes the register unit 100 that adjusts a position of the sheet 4 in the transfer direction and a position of the sheet 4 in the lateral direction perpendicular to the transfer direction while the sheet 4 is supplied from the feeder unit 2 to the printing cylinder 14. The printing apparatus 1 also includes the valve drive device 131 that switches the operation of the register unit 100 between a case in which printing is performed on one surface of the sheet 4 and a case in which printing is performed on both surfaces of the sheet 4.

Even if the drive speed of the feeder unit 2 differs between single-sided printing and double-sided printing, the sheet 4 can be stably supplied to the printing cylinder 14.

The register unit 100 of the printing apparatus 1 according to this embodiment includes the sheet sensors 106 that detect the transfer state of the sheet 4 (the presence/absence of the sheet 4 and out of square of the sheet 4) at the front lays. The side lay 101 includes the sheet sensor 123 that detects a side lay adjustment error. The sheet sensors 106 and 123 switch the detection condition between single-sided printing and double-sided printing.

It can therefore be prevented that a normal state in which the sheet sensors 106 and 123 do not detect the sheet 4 is erroneously determined as an abnormal state when the swing arm shaft pregripper 23 is in the "idle reciprocation process" in double-sided printing.

Second Embodiment

Figure 17:
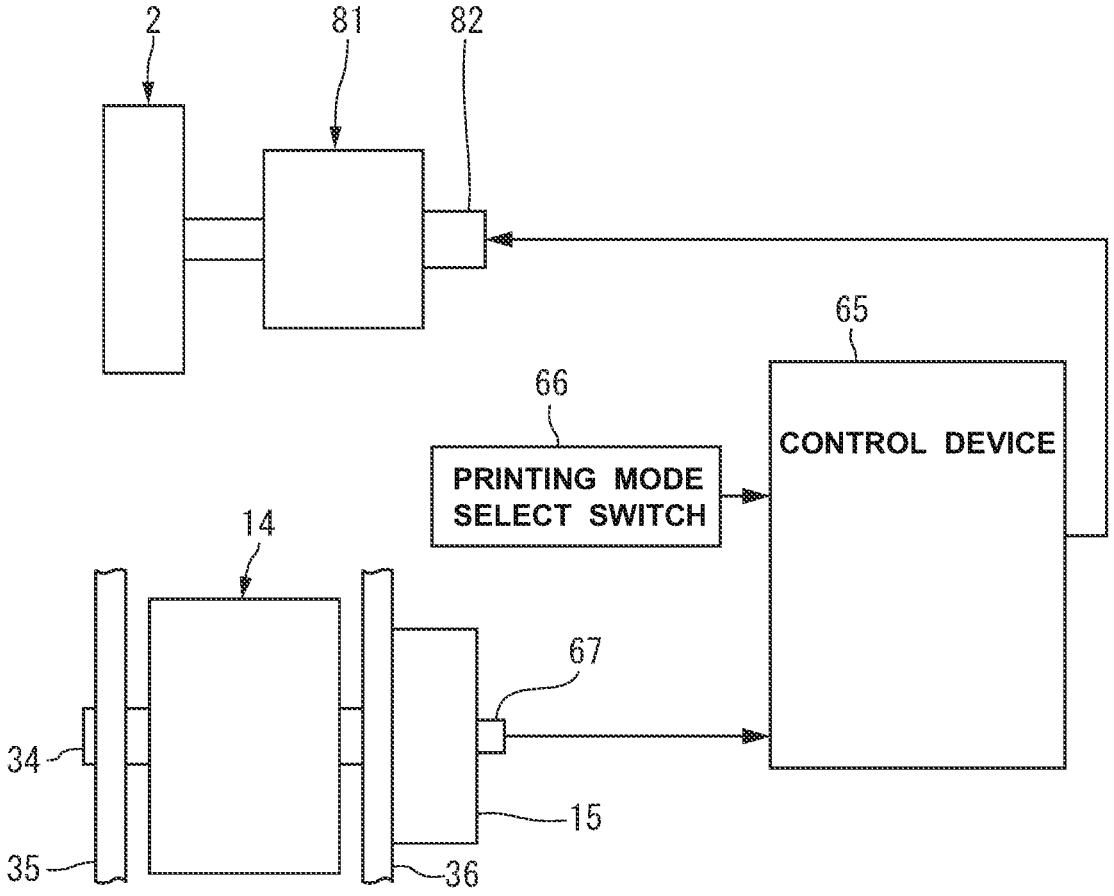
FIG. 17 is a schematic view showing the arrangement of the drive system of a sheet supply unit according to the second embodiment.

The drive system of a feeder unit can be configured as shown in FIG. 17. Members that are the same as or similar to those described with reference to FIGS. 1 to 16 are denoted by the same reference numerals in FIG. 17, and a detailed description thereof will appropriately be omitted.

A feeder unit 2 shown in FIG. 17 is connected to a single drive device 81 for the feeder unit. The single drive device 81 is formed separately from a drive device 15 that drives a printing cylinder 14.

The single drive device 81 includes a motor 82 dedicated to the feeder unit and drives the feeder unit 2 using the motor 82 as the power source. The operation of the motor 82 is controlled by a control device 65. The control device 65 controls the motor 82 to rotate at the first rotating speed in single-sided printing and at the second rotating speed in double-sided printing.

When the motor 82 rotates at the first rotating speed, a suction device 11 and a feeder board 12 operate at the first supply speed mentioned above. When the motor 82 rotates at the second rotating speed, the suction device 11 and the feeder board 12 operate at the second supply speed mentioned above.

In this embodiment, the single drive device 81 for the feeder unit constitutes "speed switching means" and "single drive device for the supply unit of a sheet 4" in the present invention.

According to this embodiment, a transmission member that transmits power between the drive device 15 and the feeder unit 2 is obviated, unlike a case in which the feeder unit 2 is driven by power transmitted from the drive device 15 of the printing cylinder 14. Since the feeder unit 2 including the drive system can be downsized, a compact printing apparatus can be provided.

Third Embodiment

The register unit 100 according to the first embodiment adopts an arrangement in which operation contents (movement of the side lay 101 and rotation of the forced front lay wheel 102) do not differ between single-sided printing and double-sided printing and the suction timing is switched by the clutches (the first and second jaw clutches 136 and 137). However, the present invention is not limited to this. The present invention can employ an arrangement in which both the operation contents of the register unit 100 and the suction timing change.

Figure 18:
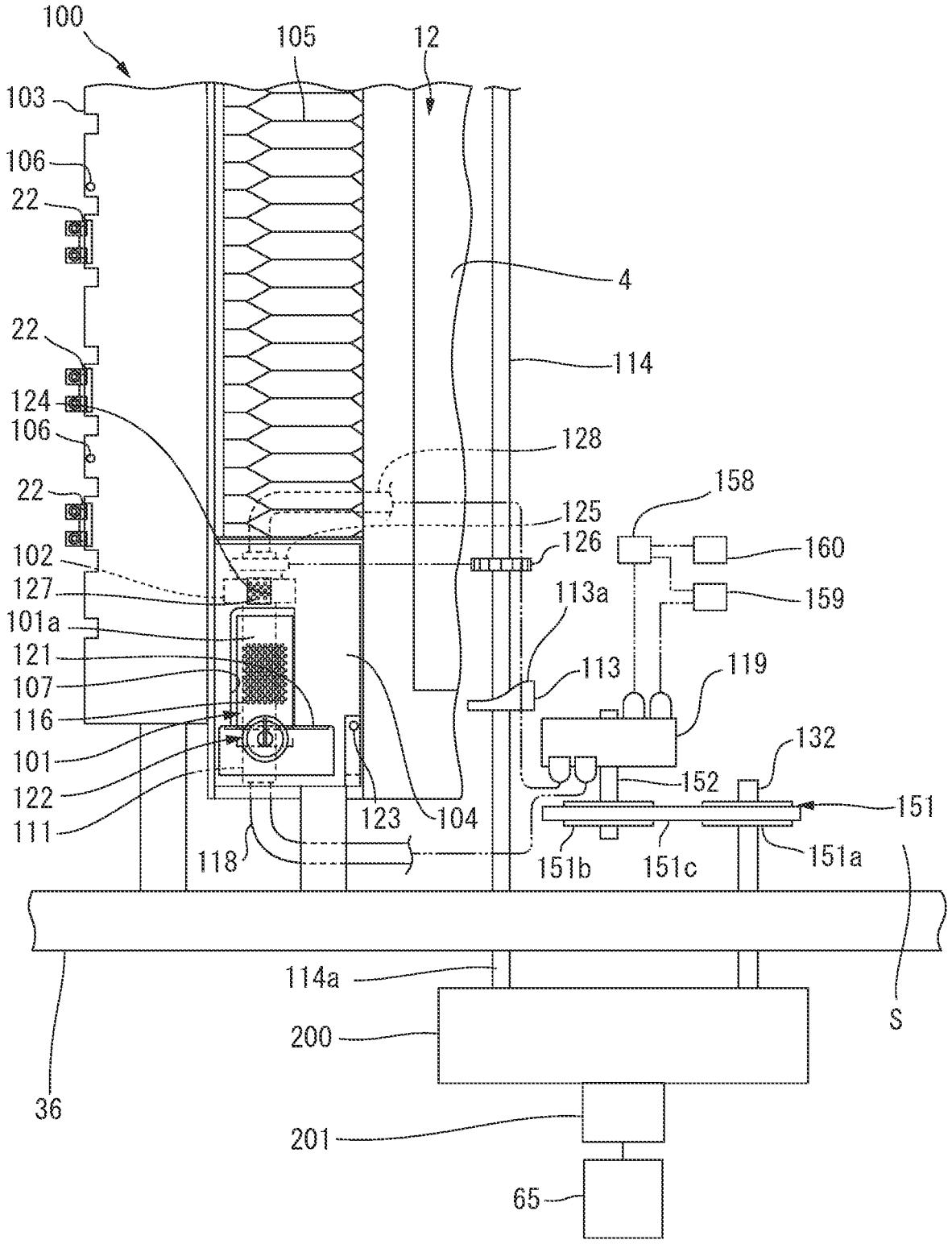
FIG. 18 is a plan view for explaining the arrangement of a register unit according to the third embodiment.

This arrangement can be implemented by connecting a single drive device 200 for a register unit 100 to a side lay drive shaft 114, as shown in FIG. 18. Members that are the same as or similar to those described with reference to FIGS. 1 to 16 are denoted by the same reference numerals in FIG. 18, and a detailed description thereof will appropriately be omitted.

The single drive device 200 for the register unit 100 operates as the power source of a single drive motor 201 for the register unit 100 independently of a drive device 15. The operation of the single drive motor 201 is controlled by a control device 65 based on the drive state of the drive device 15. In this embodiment, the single drive device 200 corresponds to "operation switching means for the register unit" in the present invention.

Each of the above-described embodiments has described an example in which in double-sided printing, the feeder unit 2 operates at the second supply speed that is ½ the first supply speed. However, the second supply speed can be slightly different from ½ the first supply speed as long as one sheet 4 can be held every time the swing arm shaft pregripper 23 reciprocates twice. However, if the second supply speed is ½ the first supply speed, the interval between the sheets 4 on the feeder board 12 becomes equal between single-sided printing and double-sided printing and generation of a transfer error can be further suppressed.

The register unit 100 according to the above-described embodiments adopts an arrangement that sucks the sheet 4 by a negative pressure and adjusts its position. However, the register unit 100 according to the present invention is not limited to this and can employ an arrangement that pinches the sheet 4 between elastic members such as rubber rollers and adjusts its position. When this arrangement is adopted, the operation switching means for the register unit 100 can be constituted by a clutch to switch the pinch operation and switch rotation of the rubber rollers. The operation switching means for the register unit 100 can also be implemented using the single drive motor for the register unit 100.

EXPLANATION OF THE REFERENCE NUMERALS AND SIGNS

1 . . . printing apparatus, 2 . . . feeder unit (sheet supply unit), 4 . . . sheet, 12 . . . feeder board, 14 . . . printing cylinder (sheet transfer unit), 15 . . . drive device, 16 . . . drive connecting means, 41-44 . . . first to fourth inkjet heads (printing units), 63 . . . first rotary shaft, 64 . . . electromagnetic clutch, 72 . . . speed reducer (speed switching means), 74 . . . second rotary shaft, 75 . . . one-way clutch.

The invention claimed is:

1. A printing apparatus which performs digital printing on one or both surfaces of a sheet, comprising:

a cylinder configured to hold sheets and transfer the sheets one by one continuously;

a printing unit configured to perform printing on the sheet transferred by the cylinder;

a stream feeder configured to supply the sheets one by one to the cylinder and to transfer the sheets in a state in which the sheets partially overlap each other in a transfer direction;

a front lay provided downstream of the stream feeder in the transfer direction and against which a leading edge of the sheet abuts; and a speed switch, for the stream feeder, configured to switch a speed of the stream feeder between a case in which printing is performed on one surface of the sheet and a case in which printing is performed on both surfaces of the sheet, wherein when printing is performed on one surface of the sheet, the stream feeder is driven at a first supply speed at which the sheets are supplied to the cylinder one by one continuously, and the cylinder is driven at a transfer speed at which the sheets supplied from the stream feeder one by one continuously are transferred, when printing is performed on both surfaces of the sheet, the cylinder is driven at the transfer speed and the stream feeder is driven at a second supply speed which is ½ the first supply speed, and the stream feeder includes a belt configured to move while sucking the sheets in a state where width of overlapping portions of the sheets in a case where printing is performed on one surface of the sheet is equal to that in a case where printing is performed on both surfaces of the sheet.

2. A printing apparatus which performs digital printing on one or both surfaces of a sheet, comprising:

a cylinder configured to hold sheets and transfer the sheets one by one continuously;

a printing unit configured to perform printing on the sheet transferred by the cylinder;

a feeder configured to supply the sheets one by one to the cylinder;

a speed reducer, for the feeder, configured to switch a speed of the feeder between a case in which printing is performed on one surface of the sheet and a case in which printing is performed on both surfaces of the sheet, a driver configured to drive the cylinder; and a drive connector configured to transmit power from the driver to the feeder via a transmission member and the speed reducer, wherein when printing is performed on one surface of the sheet, the feeder is driven at a first supply speed at which the sheets are supplied to the cylinder one by one continuously, and the cylinder is driven at a transfer speed at which the sheets supplied from the feeder one by one continuously are transferred, and when printing is performed on both surfaces of the sheet, the cylinder is driven at the transfer speed and the feeder is driven at a second supply speed which is ½ the first supply speed.

3. A printing apparatus which performs digital printing on one or both surfaces of a sheet comprising:

a cylinder configured to hold sheets and transfer the sheets one by one continuously;

a printing unit configured to perform printing on the sheet transferred by the cylinder;

a feeder configured to supply the sheets one by one to the cylinder;

a speed switch, for the feeder, configured to switch a speed of the feeder between a case in which printing is performed on one surface of the sheet and a case in which printing is performed on both surfaces of the sheet; and a first driver configured to drive the cylinder, wherein when printing is performed on one surface of the sheet, the feeder is driven at a first supply speed at which the sheets are supplied to the cylinder one by one continuously, and the cylinder is driven at a transfer speed at which the sheets supplied from the feeder one by one continuously are transferred, when printing is performed on both surfaces of the sheet, the cylinder is driven at the transfer speed and the feeder is driven at a second supply speed which is ½ the first supply speed, and the speed switch includes a second driver, for the feeder, which is constituted separately from the first driver and drives the feeder at one of the first supply speed and the second supply speed.

4. The printing apparatus which performs digital printing on one or both surfaces of a sheet, comprising:

a cylinder configured to hold sheets and transfer the sheets one by one continuously, a printing unit configured to perform printing on the sheet transferred by the cylinder, a feeder configured to supply the sheets one by one to the cylinder;

a speed switch, for the feeder, configured to switch a speed of the feeder between a case in which printing is performed on one surface of the sheet and a case in which printing is performed on both surfaces of the sheet;

a register configured to adjust a position of the sheet in the transfer direction and a position in a lateral direction perpendicular to the transfer direction while the sheet is supplied from the feeder to the cylinder; and an operation switch, for the register, configured to switch an operation of the register between the case in which printing is performed on one surface of the sheet and the case in which printing is performed on both surfaces of the sheet, wherein when printing is performed on one surface of the sheet, the feeder is driven at a first supply speed at which the sheets are supplied to the cylinder one by one continuously, and the cylinder is driven at a transfer speed at which the sheets supplied from the feeder one by one continuously are transferred, and when printing is performed on both surfaces of the sheet, the cylinder is driven at the transfer speed and the feeder is driven at a second supply speed which is ½ the first supply speed.

* * * * *